United States Patent [19]

Becze

[11] Patent Number: 4,484,748

[45] Date of Patent: Nov. 27, 1984

[54] GOOD MANUFACTURING PRACTICES BOARD GAME

[75] Inventor: Thomas D. Becze, Chesterfield, Va.

[73] Assignee: GMP Institute, Inc., Cincinnati, Ohio

[21] Appl. No.: 363,936

[22] Filed: Mar. 31, 1982

[51] Int. Cl.[3] ..... A63F 3/00; A63F 9/18

[52] U.S. Cl. ..... 273/256; 273/276

[58] Field of Search ..... 273/256, 243, 249, 276

[56] References Cited

U.S. PATENT DOCUMENTS

| | | | |
|---|---|---|---|
| 2,506,184 | 5/1950 | Twining | 273/276 |
| 3,104,106 | 9/1963 | Kenney et al. | 273/249 |
| 3,468,540 | 9/1969 | Mulligan | 273/256 |
| 3,734,508 | 5/1973 | Snyder | 273/249 |
| 3,858,885 | 1/1975 | Adcock | 273/243 |
| 3,939,578 | 2/1976 | Coffey | 273/243 |
| 4,093,235 | 6/1978 | Barry | 273/254 |
| 4,109,918 | 8/1978 | Mele et al. | 273/256 |
| 4,273,337 | 1/1981 | Carrera et al. | 273/243 |
| 4,289,313 | 9/1981 | Delamontagne | 273/256 |
| 4,343,475 | 8/1982 | Stader | 273/276 |
| 4,394,017 | 7/1983 | Moloy | 273/237 |

FOREIGN PATENT DOCUMENTS

| | | | |
|---|---|---|---|
| 2425873 | 12/1979 | France | 273/256 |
| WO81/00794 | 12/1981 | PCT Int'l Appl. | 273/251 |

*Primary Examiner*—Richard C. Pinkham
*Assistant Examiner*—Scott L. Brown
*Attorney, Agent, or Firm*—Wood, Herron & Evans

[57] ABSTRACT

A board game facilitates a player's understanding of the concepts relating to good manufacturing practices. At each turn at play, the players are required to answer a question relating to a particular facet of manufacturing. Awards and penalties result in dependence upon whether correct answers are given. The game can be played at various levels and with emphasis on particular aspects of manufacturing to suit the background and need of the players. Selected property areas are acquireable by the players and blocks are placeable on the property areas. The blocks include base block portions, first and second stackable blocks and a post. The game also uses plural sets of cards.

2 Claims, 5 Drawing Figures

| BALANCE SHEET | |
|---|---|
| ASSETS | LIABILITIES |
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| $ _____ A | $ _____ B |
| _____ A | – _____ B = _____ NET WORTH |

GOOD MANUFACTURING PRACTICES BOARD GAME

BACKGROUND OF THE INVENTION

The present invention relates to a board game, and more particularly to a board game that is designed to enhance a player's knowledge of the concepts and decisions involved in good business practices.

At present there are known a number of different types of board games. Some of these games are designed strictly for the purpose of providing entertainment for those persons who participate in the game, whereas other board games are intended to educate the players about a particular subject as well as provide a form of entertainment. Games of this latter type are generally structured so that a player's success at competing with fellow players is dependent upon his ability to master the subject matter that the game is designed to teach. The present invention is directed to a board game of this type.

It is the general object of the present invention to provide a novel educational board game that is directed to the subject of current good business processes.

It is a more specific object of the present invention to provide a novel board game that provides a palyer with insight into good business practices as they are affected by such factors as equipment and facilities, product and quality control, records, organization, and packaging, as well as more general considerations.

It is another object of the present invention to provide a novel board game that can be played at various levels in accordance with the bakcground and skills of the individual players.

A preferred embodiment of a board game implementing the objectives of the present invention is described in detail hereinafter with references to the accompanying drawings.

DETAILED DESCRIPTION

Figure 1:
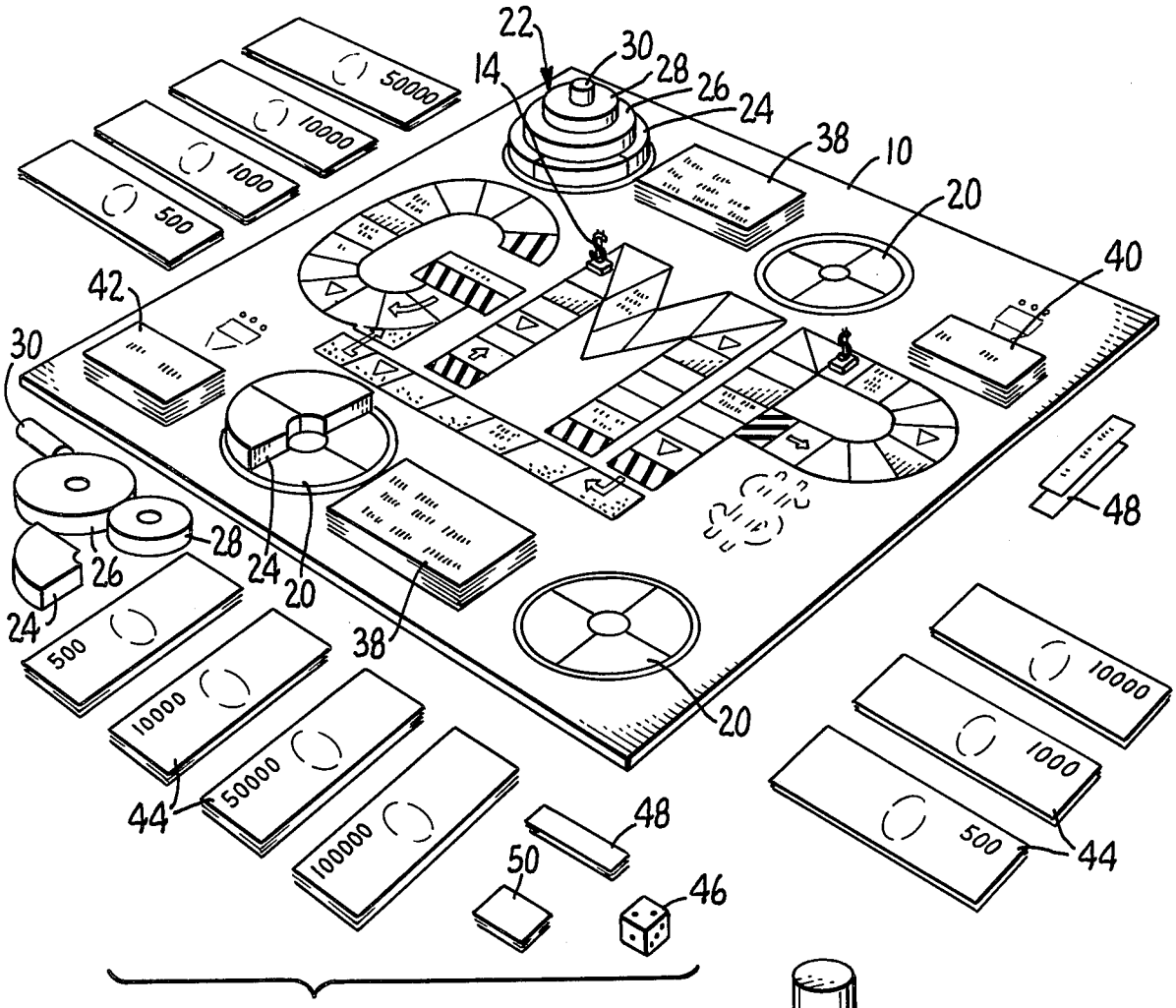
FIG. 1 is a perspective view of the board game set up for play of the game.

The various components of the illustrated embodiment of the board game of the present invention are depicted in FIG. 1 in an arrangement much as they might appear during actual play of the game. The game apparatus includes a board 10 illustrated in plan view in FIG. 4.

Figure 2:
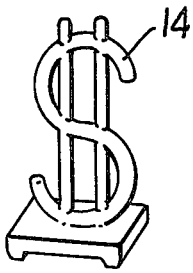
FIG. 2 is a perspective view of one of the playing pieces for the game.

The board 10 includes a multiplicity of spaces 12 over which a player advances a playing piece 14 during play of the game. One example of a suitable type of playing piece is illustrated in FIG. 2. In the game board 10 illustrated in FIGS. 1 and 4, the playing spaces 12 are provided by subdividing the block letters "GMP", which are an acronym for "Good Manufacturing Practices". It will be appreciated that other arrangements of the playing spaces are feasible as well. For example, a series of continguous blocks defining the spaces can form a continuous path around the periphery of the board.

Figures 4, 5:
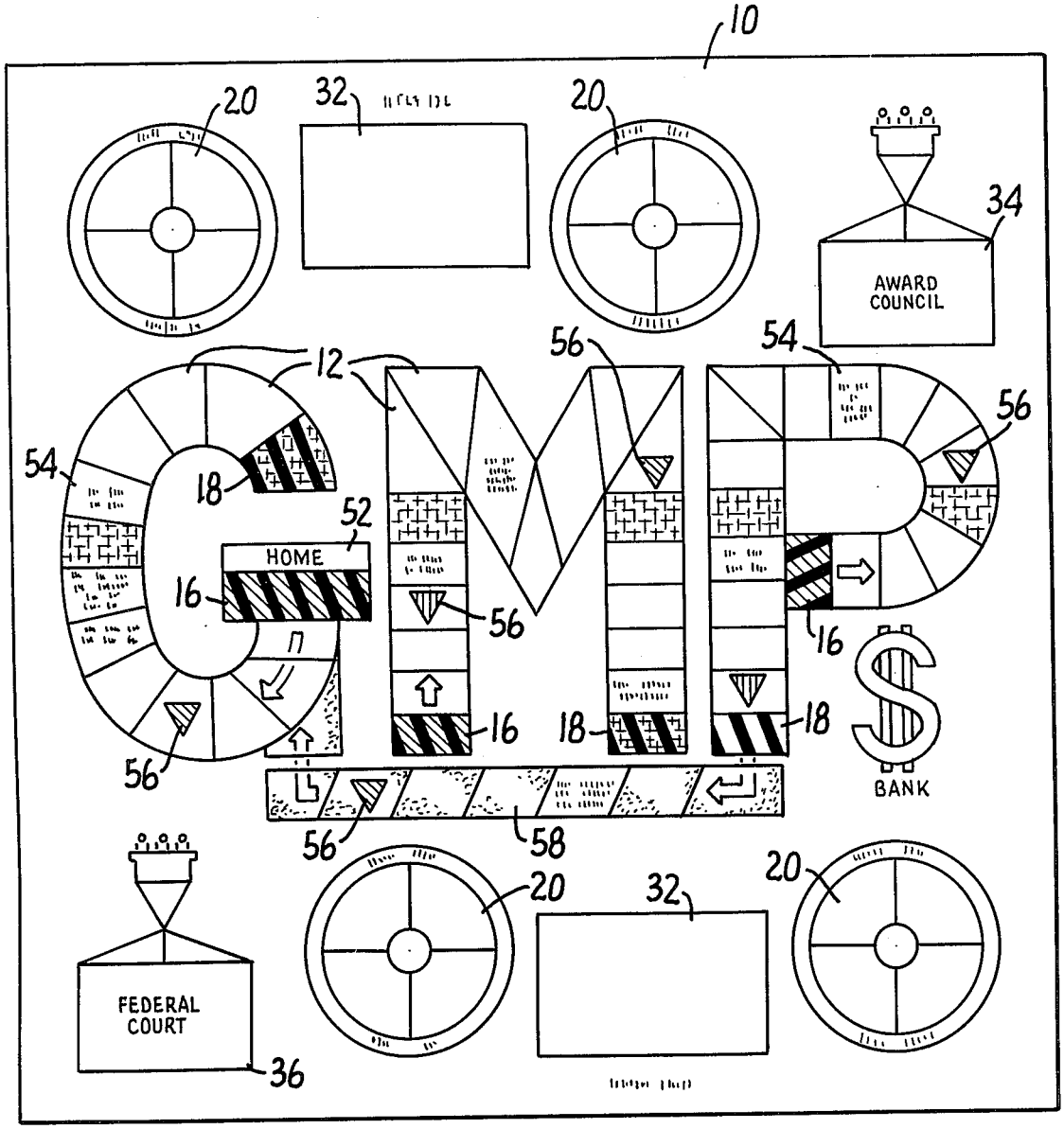
FIG. 4 is a plan view of the playing board.
FIG. 5 is an example of a balance sheet that can be used to determine a player's net worth at the completion of the game.

When the playing path is non-continuous as illustrated in the embodiment of FIG. 4, the spaces adjacent the breaks in the path can be appropriately labelled to indicate the direction of movement around the path. The space 16 at one end of the path formed by each letter can be striped and color coded, for example green, and the space 18 at the other end of each letter can be striped and coded with a different color, e.g. yellow. Thereby, when a player's piece lands on the last space 18 on the letter "G", he will be advised to proceed to the first space 16 on the letter "M" by the color-coded labelling of these spaces.

Figure 3:
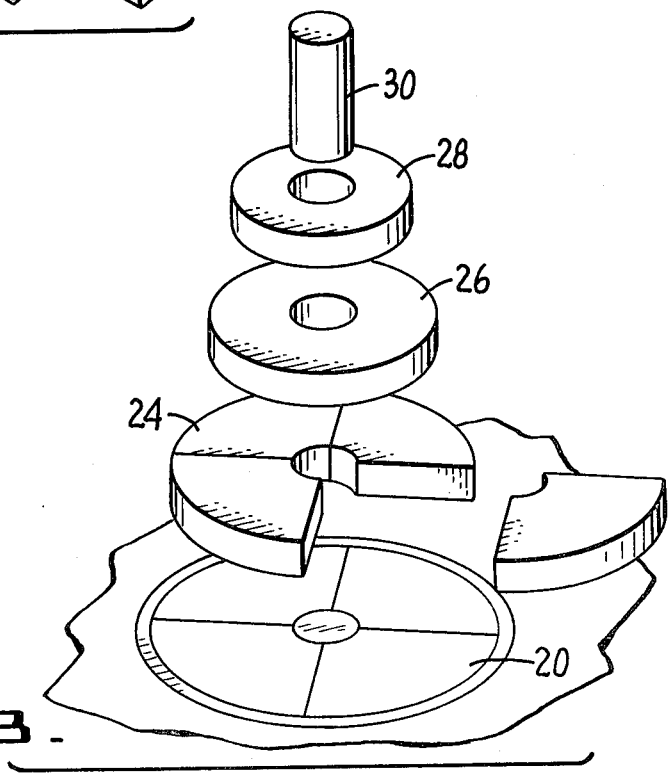
FIG. 3 is a perspective exploded view of the expansion blocks that are used to indicate building purchases and leases.

In addition to the playing spaces 12, the playing board 10 includes four circular areas 20 that represent properties that the players can purchase or lease. If the game is designed to be played by more than four players, additional property areas can be provided on the board so that there is one for each player. Each property area 20 is divided into four quadrants designating four different pieces of property that each player can acquire. Sets of expansion blocks 22 in the game apparatus indicate the building of structures on acquired property. Referring to the exploded view of the expansion blocks illustrated in FIG. 3, each set includes four quadrants 24 of approximately the same size as the quadrants in the property areas 20 and which together form a large ring. Also included are two other rings 26 and 28 of progressively smaller sizes, and a post 30 adapted to fit in the central aperture of each ring.

Blocks 32, 34 and 36 also provided on the playing surface of the board 10 designate spaces on which various decks of cards are placed. One deck of cards 38 labelled "Situation Cards" is equally divided between two spaces 32 on the board, for ease of access to the players. One side of each Situation Card contains a question pertaining to a subject that is a factor in making business decisions. The correct answer to the question appears on the reverse side of the card, and the cards are placed on the board 10 with the answer sides face down. Table 1 lists some examples of the subject matter and questions that can be provided on the Situation Cards:

TABLE I

| | SITUATION CARDS |
|---|---|
| Subject | Question |
| General | True or False: No matter what area you are working in you must abide by the SOPs (Standard Operating Procedures) of that area even if you are from a different building or department. |
| | The correct way for you to perform your GMP responsibilities in production is to:<br>(a) Rely on your supervisor's knowledge<br>(b) Consult the SOP manual in your area<br>(c) If you are an experienced employee, trust your memory<br>(d) Ask another co-worker<br>(e) All of the above. |
| Production and Process Controls | True or False: All components from the previous lot must be removed before the next lot of the same product can be brought to the line. |
| | Standard operating procedures (SOPs) are important because:<br>(a) They create more jobs<br>(b) They promote consistent work habits<br>(c) They take the place of the supervisor's responsibility |

TABLE I-continued

| Subject | SITUATION CARDS Question |
|---|---|
| | (d) They are required by the President's council on physical fitness. |
| Organization and Personnel | True or False: Any person can work in any FDA regulated area of a pharmaceutical company regardless of their education, training and/or experience. |
| Returned and Salvaged Drug Products | True or False: Returned drug products may be redistributed provided they are not less than one year from their expiration date. |

Preferably, more than one deck of Situation Cards is provided with each game. The decks can be divided into different skill levles, i.e. the questions in different decks have different levels of difficulty, to accomodate players of different capabilities. Alternatively, or in addition, the varous decks of cards can be directed to different areas of subject matter to accomodate different levels of players or different manufacturing operations. For example, one deck of cards have questions that are suitable for players in supervisory positions, whereas another deck of cards can have questions that are more appropriate for non-supervisory personnel. Or, one deck of cards can have questions directed generally to manufatcuring practices, and another deck can have questions directed to a specific area of manufacturing, such as distribution or quality control, for example.

A second deck of cards 40 located on another one of the spaces 34 is labelled "Award Council". Each card in this deck describes an award or bonus that is associated with the exercise of good business judgement. Examples of the types of awards that can be described in the Award Council deck of cards are listed in Table 2 below:

TABLE 2

| AWARDS COUNCIL | |
|---|---|
| Through Their Quality-Conscious Efforts, the Personnel In your Area Have Increased Your Profits by Eliminating 95% of the Previous Year's Rework Costs. Collect $100,000 Per Expansion. | The Board of Directors Has Agreed to Build One of Your Expansions at no Direct Cost to You. You must Pay the 20% Property Tax to the Bank. |
| Collect Dividends on Your Stock Investments. $10,000 Times a Roll of the Dice. | New High-Speed Production Line Has Increased Product Quality as Well as Profits. Advance Ten Spaces and Collect $50,000 |

A third deck of cards 42 labelled "Federal Court" is located on the other space 36 on the board 10. Each of these cards describes a situation that generally results in a fine or similar type of penalty that can be imposed on a manufacturer, for example due to violations of legal or regulatory controls. Examples of the types of situations that can be described in the "Federal Court" cards are listed in Table 3 below:

TABLE 3

| Federal Court | |
|---|---|
| CLASS III RECALL | Distribution Records For Six |
| Your Product is Subpotent | Lots of Your Product Were |
| JUDGEMENT | Unable to Provide Retrievable |
| Pay $350,000 Penalty. | Data For a Pending Recall. |
| Return to Home (Do Not | JUDGEMENT |
| Collect $100,000). | Lose 2 Turns and $10,000 |

TABLE 3-continued

| Federal Court | |
|---|---|
| SEIZURE | CLASS I RECALL |
| Product Was Released Even Though Quality Control Records Indicated a Manufacturing | Foreign Tablets Found Mixed With Your Product. |
| Problem That Went Unresolved. | JUDGEMENT |
| JUDGEMENT | Pay Each Active Player $200,000 |
| You must retire From the Game. | Lose 2 Turns |
| Forfeit All Monies and Holdings to the Competition (the Other Active Players.) | |

The decks of Award Council and Federal Court cards can similarly be divided into two or more subsets respectively directed to players at different levels or different aspects of manufacturing.

The playing apparatus for the game also includes such items as bills 44 of various denominations of money, a die or dice 46 for indicating the number of spaces each player should move during a turn at play, markers 48 for indicating each loss of a turn at play, and loan cards 50 for indicating various amounts of money that can be loaned to players and the interest payable thereon.

To set up for play of the game, each player receives a predetermined sum of money, e.g. $1,000,000, and a playing piece. One of the players is selected as a banker, or an extra person who is not a player can serve the role of banker. The banker holds all of the remaining money, the lost turn markers 48, the loan indicators 50 and the expansion blocks 22. The particular decks or subsets of cards 38, 40 and 42 that are appropriate for the players of the game and the aspect of business that is to be taught are placed on the board 10.

To begin play, one of the players draws a situation card 38 from the nearest deck, and reads the question aloud for the rest of the players to hear. All of the players can discuss the question but not the answer. After discussion is completed the player who drew the card must announce an answer, and then turn the card over for comparison with the correct answer. If the player's answer is correct, he rolls the die or dice 46 and moves his playing piece from a HOME starting space 52 along the playing path a number of spaces determined by the roll. If the player's answer is incorrect, he loses his turn and receives a lost turn marker 48 from the banker.

Play continues in this manner, with each player drawing a situation card and giving an answer, and then either advancing his playing piece or losing his turn in dependence upon whether his answer is correct. In addition to moving according to the roll of the dice 46, advancement of the playing pieces can be controlled by indicia on various spaces 54 on the board 10. This indicia can be directions such as "Go Back 2 Spaces" or "Return Home Immediately".

If two playing pieces 14 occupy the same space at the end of a player's turn, the piece approaching the other playing piece must return to the HOME space 52 without the benefit of collecting any bonuses associated with that space. However, various ones of the spaces 12 can be color coded or otherwise suitably marked to indicate safety zones that can be shared by two or more pieces without sending one of them HOME.

For every three correct answers, a player earns the right to draw a card from the Awards Council deck 40. For every three lost turn markers a player receives, he must draw a Federal Court card 42. All players are bound by the action stated on a card. After it is played, a card is returned to the bottom of its deck.

The foregoing description is the most basic level at which the game is played. Additional levels can be implemented as allowed by the skill of the players and their familiarity with the game. For example, at a second level, other indicia 56 on the board 10 can be recognized, such as color-coded directions to pick up one of the Awards Council or Federal Court cards 40 or 42. Each time a player completes a trip around the board and passes by the HOME space 52, he can receive a fixed sum of money, e.g. $100,000.

In addition to the path of spaces 12 provided by the letters "GMP", an additional optional path 58 can also be provided on the board 10. In the example of FIG. 4, this additional path 58 appears as underlining to the letters "GMP". At a third level of play, this additional path can be utilized to influence fortunes befalling a player. For example, if a player passes through this portion of the playing path without stopping, each space is counted as usual. However, if the player stops on this portion of the path, whatever fortune befalls him is multiplied by 2. This, the next roll of the dice is doubled, the award or fine indicated by one of the Awards Council or Federal Court cards is multiplied by 2, and an action normally resulting in the loss of a turn will result in the loss of two turns.

The third level of play can also include the opportunity to expand through acquisition of a property area 20. Each quadrant of the property area is assigned a purchase price, e.g. $225,000. Each piece of property can be purchased with a minimum of 50% down, with the balance paid by a bank load at 20% interest per year on the outstanding balance over a maximum five-year period. Each trip around the playing path is considered to be one fiscal year, and all interest and principal payments become due when a player reaches the HOME space 52.

At the fourth level of play, the players can have the opportunity to purchase expansion blocks 22 and obtain a return or dividend on the properties they have purchased. Each block has a designated purchase price, e.g. $250,000 per quarter 24 of the large ring, $350,000 for the medium ring, $450,000 for the small ring, and $550,000 for the post. A piece of property 20 must be purchased before a player can build any of the expansion blocks. A player may buy one quadrant of property followed by an expansion block 24 on that quadrant, if desired. It is not necessary to purchase all of the property before building. However, all four quarters of the large ring must be built before any of the other sections can be acquired. These other sections can be obtained in random order. A simple alternative to the purchasing concept would be to use only the quarters 24 of the large ring. If each set of blocks is a different color, different purchase prices can be assigned to quarters of different colors, and can be intermixed by the players.

The annual return on purchased properties and buildings can be 25% of the total purchase price of all holdings. This return is paid by the bank at the end of each fiscal year when a player reaches the HOME space 52.

A fifth level of play can include the concept of leasing the available properties 20 and blocks 22, as well as buying them. Each piece of property and block is assigned an annual rental value equal to 30–45% of its purchase price, payable for five years. No down payment is required and no loans are permitted for lease financing. The return on all leased properties and structures is 10% of the purchase price of all holdings, and is similarly paid at the end of each fiscal year.

Another level of play can provide players with the opportunity to make additional investments and acquisitions. For example, a player can invest his money with the bank. The money remains in the custody of the banker for a period of two years and earns a return of 15% interest per year. Penalty for early withdrawal is forfeiture of all interest for the entire two year period.

A player can buy or lease another player's property or structures when his own expansion property is "saturated", with the consent of both players involved. The player purchasing new property or buildings must pay a 10% commission to the seller if the property or structure is owned by the seller. If they are not owned, the buyer can acquire the property or structures at the regular purchase price plus a 5% commission paid to the bank, payable at the time of purchase. To identify investments of this type, a player places his blocks on the newly acquired property and uses the seller's blocks on his own property.

If a player is directed to divest some of his holdings, for example by a court order, and a buyer cannot be found, the player may have to auction those holdings. The player is the auuctioneer unless an "independent" banker is available. All money collected by the auction goes to the seller, except for a 5% commission paid to an independent banker.

At the end of the game, each player's net worth is determined. Such determinations can be made with the use of a balance sheet such as that illustrated in FIG. 5. All assets of a player, including wholly owned property, expansion blocks, "foreign" investments, dividends and cash-on-hand, are listed on the left side of the sheet and totalled. All liabilities such as unpaid loans, outstanding interest and other debts are listed on the right side of the sheet and totalled. Net worth is determined by subtracting total liabilities from total assets. The players with the highest net worth is declared to be the winner.

From the foregoing it will be appreciated that the board game of the present invention is an effective tool for providing players with a working knowledge of the concepts involved in business practices. It is particularly useful for manufacturing entities, such as corporations, to teach their employees about various facets of the business. The use of different sets of situation cards directed to different aspects of the business, as well as directed to different skill levels, and the ability to play the game at varous levels of difficulty, enables the game to be tailored to the particular players. Thereby, a player's interest in the game will be maintained, and the educational opportunity consequently enhanced.

It will be apparent to those of skill in the art that the present invention can be embodied in other specific forms without departing from the spirit or essential characteristics thereof. The presently disclosed embodiment is therefore considered in all respects to be illustrative and not restrictive. The scope of the invention is indicated by the appended claims rather than the foregoing description, and all changes that come within the meaning and range of equivalency of the claims are therefore intended to be embraced therein.

I claim:

1. A board game for providing a player with a working knowledge of business practices, comprising:

a playing board having a playing surface including a plurality of spaces forming a path of movement over which a player advances during play of the game;

a plurality of playing pieces for indicating each player's position on one of said spaces;

a first set of cards containing information in the form of questions and answers relating to situations that are encountered in business;

a second set of cards containing information relating to awards associated with good business practices;

a third set of cards containing information relating to penalties encountered by a businessman;

chance indicator means for controlling movement of said playing pieces over said spaces;

a plurality of property areas divided into sections which are separately acquirable by the players or the game, which areas do not comprise a portion of the path of movement; and vertical expansion blocks which can be acquired by the players of the game for placement on a property area, the expansion blocks including a base block, each base block comprising a set of base block portions which each correspond in general shape to a property area section, a first stackable block which can be stacked on the base block, a second stackable block which can be stacked on the first stackable block and the base block, and a post, the base block and first and second stackable blocks having an opening therethrough through which the post can extend.

2. The game of claim 1 wherein the second block is smaller than the first block, and the first block is smaller than the base block.

* * * * *